United States Patent [19]

Suffi et al.

[11] Patent Number: 4,571,013

[45] Date of Patent: Feb. 18, 1986

[54] CONNECTOR FOR CABLE SHIELDS

[75] Inventors: Louis Suffi, Westchester; Frederick W. Burtelson, Harvard, both of Ill.

[73] Assignee: Northern Telecom Limited, Montreal, Canada

[21] Appl. No.: 537,440

[22] Filed: Sep. 30, 1983

[51] Int. Cl.[4] ..... H01R 4/24; H01R 13/648

[52] U.S. Cl. ..... 339/14 R; 339/95 R

[58] Field of Search ..... 339/14 R, 14 L, 95 R; 174/78, 84 C

[56] References Cited

U.S. PATENT DOCUMENTS

| | | | |
|---|---|---|---|
| 3,253,247 | 5/1966 | Vos | 339/95 R |
| 3,643,006 | 2/1972 | Ance | 339/95 R X |
| 3,778,749 | 12/1973 | Kapell | 174/78 X |
| 3,864,009 | 2/1975 | Wickenberg | 339/95 R |
| 4,053,703 | 10/1977 | Smith | 339/14 L X |
| 4,353,612 | 10/1982 | Meyers | 339/95 R |
| 4,406,505 | 9/1983 | Avramovich | 339/14 R |

*Primary Examiner*—Eugene F. Desmond

*Attorney, Agent, or Firm*—Schwartz, Jeffery, Schwaab, Mack, Blumenthal & Evans

[57] ABSTRACT

A connector for cable shields comprises a U shaped bent strip of metal forming inner and outer spaced legs. Tangs are formed in each leg, extending inwards toward each other. A bolt and nut extending through the legs near the bend acts to clamp the legs together. The ends of the legs can be shaped, to assist in inserting into a cable, and to provide extra gripping formations. The legs can be strengthened by ribs along their side edges.

9 Claims, 12 Drawing Figures

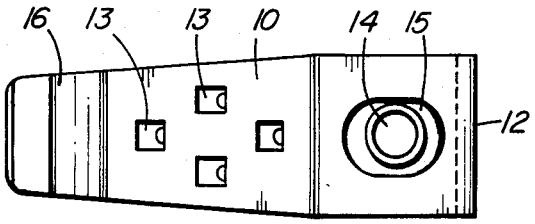
FIG. 1
FIG. 2
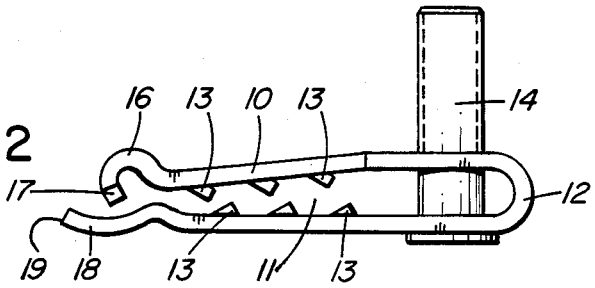
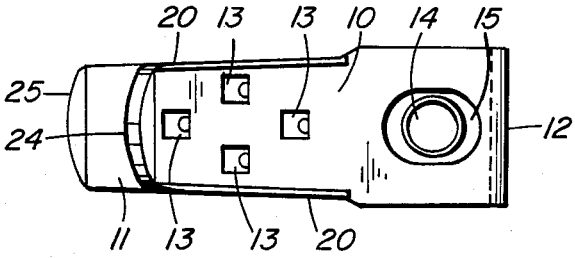
FIG. 3
FIG. 4
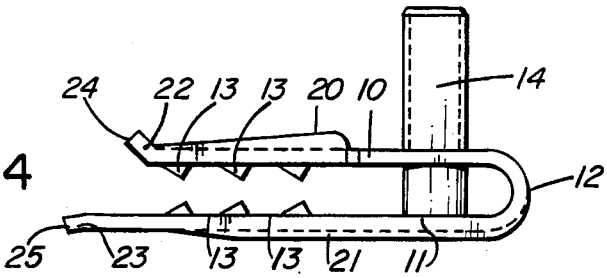

CONNECTOR FOR CABLE SHIELDS

Cables for telecommunications, and similar systems, usually have a metal shield, the shield wrapped or formed round the cable core, with a protective coating or layer over the shield. The shield provides a continuous electrical connection or circuit for the length of the cable.

When a cable is cut, the outer coating and metal shield are removed for some distance, to provide access to the conductors. When two cables are connected, the outer cover and the metal shield are removed for a short length from the cable ends. In a further situation, the cable may not be cut, but the cover and metal shield are removed for some distance to provide access to conductors, for splicing-in of a tap connection, for example.

In all of these examples, cutting and removal of the metal shield interferes with the electrical continuity of the metal shield and also reduces the tensile strength of the cable at that position. It is normal to provide a metal strap between the opposed ends of the metal shield, to provide electrical continuity, and restore, at least to some extent, the tensile integrity of the cable.

The strap is attached to the cable shield by clamps. The clamps should be easy to apply and once fastened, should resist pulling out. At the same time, for economy and convenience, a clamp should have as few separate parts as possible.

The present invention provides a connector for cable shields comprising a clamp in the form of a length of metal bent to a U form, with two spaced, opposed legs; tangs formed in each leg, the tangs extending inward into the space between the legs and inclined rearward towards the bend connecting the legs; and a clamping bolt extending through the legs adjacent to the bend. The legs are formed at each side to provide additional strength and the front ends of the legs can be formed to assist in insertion of the clamp. A further gripping formation can be provided at the front ends of the legs.

The invention will be readily understood by the following description of certain embodiments, by way of example, in conjunction with the accompanying drawings, in which:

FIGS. 1 and 2 are diagrammatic top and side views respectively of one form of connector or clamp;

FIGS. 3 and 4 are diagrammatic top and side views respectively of another form of connector or clamp;

Figure 9:
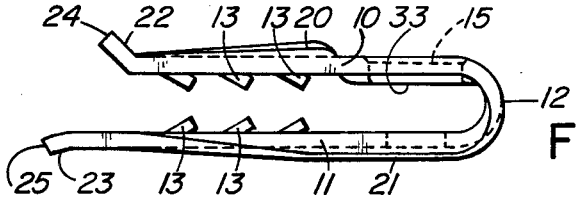
Figure 10:
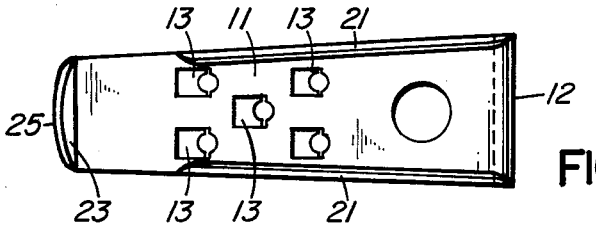
Figure 11:
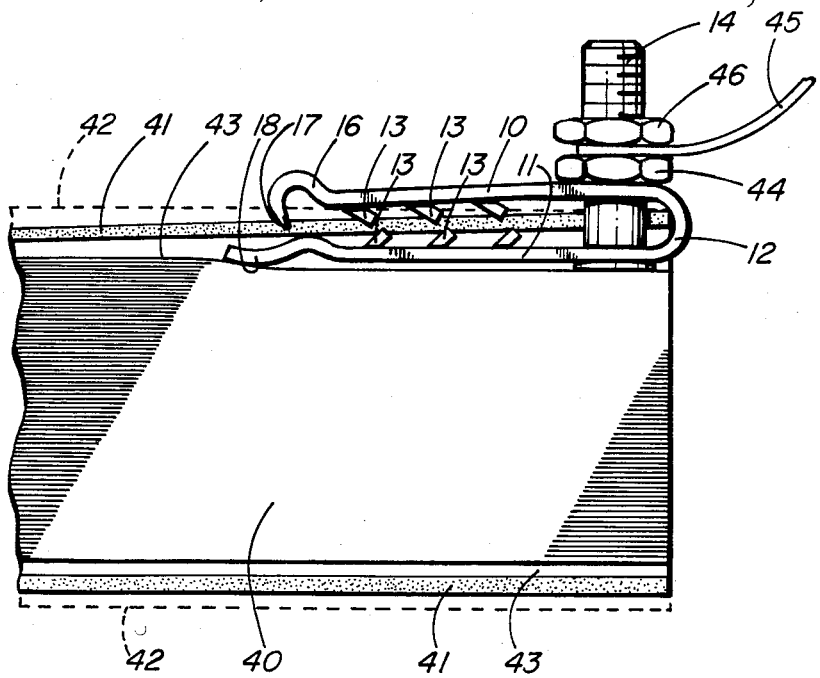
Figure 12:
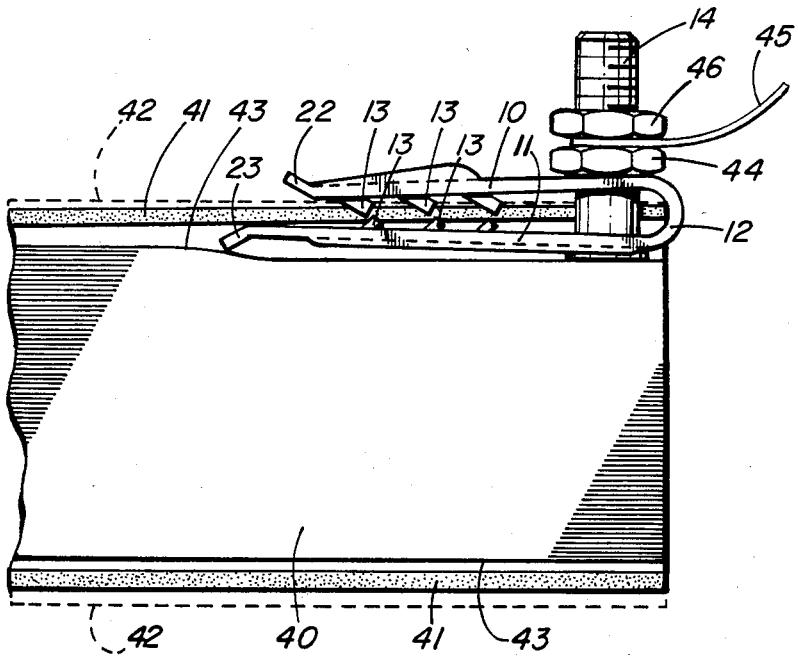

FIGS. 11 and 12 are cross-sections illustrating the clamps of FIGS. 5, 6 and 7 and FIGS. 8, 9 and 10, respectively, attached to a cable.

The clamp illustrated in FIGS. 1 and 2 comprises a strip of metal bent over in a U form, to provide spaced opposed legs 10 and 11 united at one end by the bend 12. Pointed teeth or tangs are formed in each leg, at 13, by punching or otherwise deforming localized sections of metal from the legs. The teeth 13 face inwards and rearwards towards the bend 12. A threaded stud 14 is positioned in a hole in one leg and passes through a hole 15 in the other leg, adjacent to the bend 12. A nut can be screwed on to the stud 14 to tighten the legs 10 and 11 towards each other. The forward end of the top or outer leg 10, is formed to give a hooked shape, viewed from the side, at 16. The end 17 faces rearward and can be serrated to form additional teeth.

The forward end 18 of inner leg 11 is given a slightly arcuate shape, viewed from the side, and the end surface 19 is slightly convex, to assist in pushing this leg between the cable core and the shield, and avoiding damage to any core wrapping provided. The teeth 13, and the teeth on the end 17, act to prevent pulling out of the clamp, once tightened, the teeth biting into the sheath.

The clamp illustrated in FIGS. 3 and 4 again comprises a strip of metal bent over in a U form with spaced opposed legs 10 and 11, joined by the bend 12. Teeth or tangs 13 are formed in the legs 10 and 13. A threaded stud 14 is provided, positioned in a hole in leg 11 and passing through a hole 15 in leg 10. The outer leg 10 is formed at each edge, at 20 to create a rib or lip at each edge to strengthen the leg against bending. Similarly inner leg 11 is formed at each edge, at 21, to form a rib or lip.

The forward end 22 of leg 10 is bent upwards and the tip 23 of the leg 11 is bent downwards, to ease insertion into a cable. The end surfaces 24, 25 are slightly convex.

Figure 5:
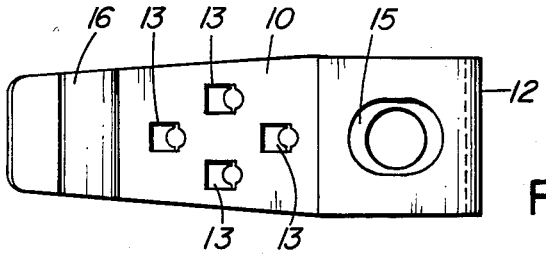
FIGS. 5, 6 and 7 are top plan view, side view and bottom plan view respectively of a clamp as in FIGS. 1 and 2, illustrating further details of the clamp.
Figure 6:
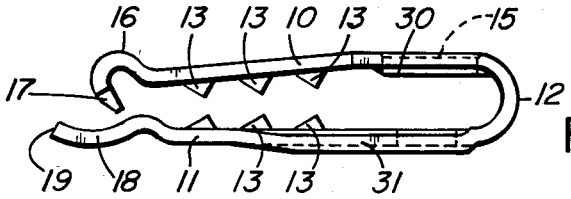
Figure 7:
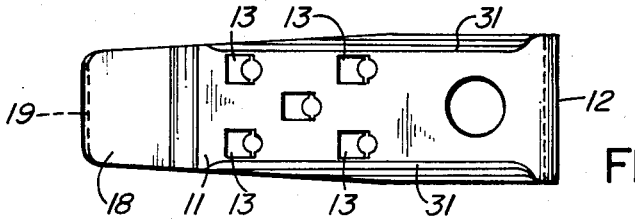

FIGS. 5, 6 and 7 illustrate the clamp of FIGS. 1 and 2 in more detail. As is seen in FIGS. 5 and 6 the hole 15 through which the stud passes is slightly elongate. This permits of some variance in bending as the holes, and the teeth, are formed prior to bending. Also an elongate hole provides room for relative movement between stud and leg 10 when the clamp is tightened. To strengthen the leg 10 around the hole, the periphery of the hole can be bent downwards to form a shallow rim or lip 30. The leg 11 can be strengthened by a rib or lip 31 formed along each edge.

On tightening the clamp, the teeth formed on the end 17 are forced into the cable sheath, as are also the teeth, or tangs, 13. The clamp can be arranged to give a maximum bite, on gripping, at the forward end of the clamp, with a gradual reduction towards the end of the sheath, which will be at or near the bend 12.

Figure 8:
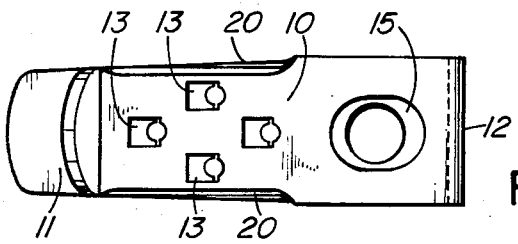
FIGS. 8, 9 and 10 are top plan view, side view and bottom plan view respectively of a clamp as in FIGS. 3 and 4, illustrating further details of the clamp.

FIGS. 8, 9 and 10 illustrate the clamp of FIGS. 3 and 4 in more detail. As in the clamp of FIGS. 5, 6 and 7, the hole 15 is elongate and the leg 11 can be strengthened around the hole by forming a shallow rim or lip 33. The strengthing ribs or lips 20 and 21 are also shown. On tightening the clamp, again a maximum bite can be achieved at the forward end of the clamp, with a gradual reduction towards the end of the sheath, agjacent to the bend 12.

FIGS. 11 and 12 illustrate the clamps attached to cables. In FIG. 11 the cable core is indicated at 40, the cable shield at 41. Usually there is an outer layer over the shield, indicated by dotted lines 42. To apply a clamp, after a cable has been cut, or at the end of a cable, the shield 41 is slit axially for a short distance together with the outer coating if present. The coating is then usually removed for a short distance. The clamp is applied by inserting the end 18 between the core and the shield and pushing in the clamp. It can be necessary to tap the clamp at the bend 12 to push it in. The stud 14 enters the slit and eventually the end of the shield abuts the bend 12. There is usually a core wrap 43 round the core 40, and the shaping of the ends of the leg 11 assists in avoiding damage to the core wrap.

The clamp is tightened on the shield by nut 44, this forcing the teeth 13, and the serrated end 17, into the shield. It can also occur that the shield will be slightly distorted by being pushed down into the arcuate end 18 of the leg 11, by the end of leg 10. A ground wire, or strap 45 is then attached to the stud 14 by nut 46.

In FIG. 12 a similar method is used to attach the clamp. Tightening nut 44 clamps the legs together and the teeth 13 enter the shield 41. The ground wire or strap 45 is applied and clamped by nut 46.

A similar clamp is attached to the other cable end and the ground wire or strap 45 is attached at its other end to the further clamp. This provides both an electrical and a mechanical connection between the two cable ends. Continuity of the cable shield is provided.

When the cable is not cut, but only the jacket or coating removed and a short length of shield cut out to expose the cable core, a similar attachment of two clamps, to the cut ends of the shield, is required to provide shield continuity. Such occasions arise in aerial splices and similar situations.

The clamps have certain advantages. The teeth 13 scrape the shield during clamp installation and also have a large contact area. The clamp is of a single piece structure plus a stud and two nuts. No disassembly is necessary before installation. Energy retention is obtained by both the clamp design and the stud/nut design. The stud can be permanently attached, as by being a force fit in leg 11 or by other means. The particular form or design—a bent strip—gives two paths for current flow, one path through the stud and one through the bend to the outer leg—contacted by the nut. This improves the thermal and electrical characteristics of the system.

The strip is usually of plated brass. Instead of slitting the shield, it is possible to insert the clamp, with one leg between the core wrapping and the shield, and press or tap in until the end of the shield is in contact with the stud.

What is claimed is:

1. A connector for cable shields, the connector being in the form of a clamp comprising a length of metal bent to a U shape forming a bend and including two spaced, opposed, legs; tangs formed in each leg, the tangs extending inward into the space between the legs; said legs forming inner and outer legs, the outer leg including a forward end remote from said bend, said forward end having a hooked shape viewed from a side, the hooked shape extending outwards, then forward, round and inwards to a rearward facing end surface; and a clamping bolt extending through the legs adjacent to the bend.

2. A connector as claimed in claim 1, said tangs being inclined inwards and rearwards toward said bend.

3. A connector as claimed in claim 1, said legs forming inner and outer legs, said bolt extending from said inner leg outwards and through said outer leg.

4. A connector as claimed in claim 3, said bolt extending through an elongate hole in said outer leg, and including a lip formed around the periphery of the hole.

5. A connector as claimed in claim 1, said end surface being serrated.

6. A connector as claimed in claim 1, said legs forming inner and outer legs, the inner leg including a forward end remote from said bend, said forward end having an arcuate shape viewed from the side, the inner surface of the forwrad end being concave relative to the outer leg.

7. A connector as claimed in claim 6, the end surface of said inner leg being convex.

8. A connector as claimed in claim 1, said legs forming inner and outer legs, including a rib formed along each side of the inner leg.

9. A connector as claimed in claim 1, said legs forming inner and outer legs, including a rib formed along each side of the outer leg.

* * * * *